US007479878B2

(12) United States Patent
Maki et al.

(10) Patent No.: US 7,479,878 B2
(45) Date of Patent: Jan. 20, 2009

(54) TRIBOELECTRIC, RANGING, OR DUAL USE SECURITY SENSOR CABLE AND METHOD OF MANUFACTURING SAME

(75) Inventors: Melvin C. Maki, Ontario (CA); Robert Keith Harman, Almonte (CA)

(73) Assignee: Senstar-Stellar Corporation, Carp, Ontario (CA)

( * ) Notice: Subject to any disclaimer, the term of this patent is extended or adjusted under 35 U.S.C. 154(b) by 164 days.

(21) Appl. No.: 10/566,195

(22) PCT Filed: Jul. 28, 2004

(86) PCT No.: PCT/CA2004/001412

§ 371 (c)(1),
(2), (4) Date: Jan. 31, 2007

(87) PCT Pub. No.: WO2005/013225

PCT Pub. Date: Feb. 10, 2005

(65) Prior Publication Data

US 2008/0024297 A1 Jan. 31, 2008

Related U.S. Application Data

(63) Continuation-in-part of application No. 10/627,618, filed on Jul. 28, 2003, now Pat. No. 6,967,584.

(51) Int. Cl.
*G08B 13/00* (2006.01)

(52) U.S. Cl. ..... 340/566; 340/552; 340/554; 340/564

(58) Field of Classification Search ..... 340/525, 340/532–535, 552, 554, 561, 566
See application file for complete search history.

(56) References Cited

U.S. PATENT DOCUMENTS 2,787,784 A 4/1957 Meryman et al.

(Continued)

FOREIGN PATENT DOCUMENTS

GB 1278149 6/1972

OTHER PUBLICATIONS

Jan. 18, 2007 Ryne C. Allen, Triboelectric Generation: Getting Charged, Desco Industries, Inc., Employee Owned, Dec. 2000—URL:http://www.esdsystems.com.

(Continued)

*Primary Examiner*—George A Bugg
*Assistant Examiner*—Samuel J Walk
(74) *Attorney, Agent, or Firm*—Volpe and Koenig PC

(57) ABSTRACT

The present invention provides an inexpensive security sensor cable, a method for manufacturing of same and an overall security system for using that sensor cable. The sensor cable consists of a central conductor, an air separator, a polyethylene dielectric tube, an outer conductor and an outer protective jacket. The central conductor is loosely centered in the coaxial cable and thus freely movable relative to the dielectric tube. The sensor cable has application either in a passive sensing system or in an active ranging sensing system to determine the location of an intrusion along the cable. For the passive sensing function, when the center conductor moves, it contacts a suitable dielectric material from the triboelectric series, such as polyethylene, which can be processed to produce a charge transfer by triboelectric effect that is measurable as a terminal voltage. In an active system, the central conductor moves within the dielectric in response to a vibration to provide an impedance change that can be sensed. Conventional radio grade cable may be modified in its construction by removing its dielectric thread to manufacture the sensor cable, thus enabling the center conductor to move freely in the air gap within the dielectric tube. An inexpensive method of manufacturing sensor cable is provided as the cable parts are readily available. Such a sensor cable is advantageous in that the passive triboelectric properties of the cable, in response to a disturbance, can provide a larger voltage response over prior art cables.

23 Claims, 7 Drawing Sheets

U.S. PATENT DOCUMENTS

| | | | |
|---|---|---|---|
| 3,707,709 | A | 12/1972 | Wolf et al. |
| 3,750,127 | A | 7/1973 | Ayers et al. |
| 3,763,482 | A | 10/1973 | Burney et al. |
| 3,846,780 | A | 11/1974 | Gilcher |
| 4,047,166 | A | 9/1977 | Miller et al. |
| 4,091,367 | A | 5/1978 | Harman |
| 4,155,083 | A | 5/1979 | Slaats et al. |
| 4,197,529 | A | 4/1980 | Ramstedt et al. |
| 4,598,168 | A | 7/1986 | Wagner et al. |
| 4,703,433 | A | 10/1987 | Sharrit |
| 5,268,672 | A | 12/1993 | Kerr |
| 5,446,446 | A | 8/1995 | Harman |
| 5,448,222 | A | 9/1995 | Harman |
| 5,473,336 | A | 12/1995 | Harman et al. |
| 5,585,546 | A | 12/1996 | Gururaja et al. |
| 5,705,984 | A | 1/1998 | Wilson |
| 5,764,729 | A | 6/1998 | Black et al. |
| 5,940,054 | A | 8/1999 | Harris |
| 5,986,549 | A | 11/1999 | Teodorescu |
| 6,087,936 | A | 7/2000 | Woods |
| 6,208,946 | B1 | 3/2001 | Arakawa et al. |
| 6,218,961 | B1 | 4/2001 | Gross et al. |
| 6,246,322 | B1 | 6/2001 | LeDain et al. |
| 6,335,683 | B1 | 1/2002 | Bouillet |
| 6,577,236 | B2 | 6/2003 | Harman |
| 2002/0041232 | A1 | 4/2002 | Harman |
| 2002/0060639 | A1 | 5/2002 | Harman |
| 2004/0114888 | A1 | 6/2004 | Rich et al. |
| 2005/0024210 | A1 | 2/2005 | Maki |

OTHER PUBLICATIONS

Jan. 18, 2007 Electrostrictive vis Magnetostrictive, Electrowave Ultrasonics Corporation—URL:http://www.electrowavecorp.com/images-and-links/electrostrictive-vis-magnetostrictive.htm.

Jan. 18, 2007 "Electrets vs Dielectric Absorbers"—http://energy21.freeservers.com/electrets.htm.

Jan. 18, 2007 "Electrostatics and its Applications"—A.D. Moore, 1973, pp. 66.

Jan. 18, 2007 "Handbook of Electrostatic Discharge Controls"—Bernard S. Matisoff, 1980, pp. 16.

Jan. 18, 2007 "Understanding and Controlling Static Electricity"—G. Luttgens and N. Glor, 1989, pp. 44.

Jan. 18, 2007 "Plastics for Electrical Insulation"—Paul F. Bruins, 1968, pp. 50.

Jan. 18, 2007 Fred G. Geil, et al., Westinghouse Research Laboratories, "Wire-In-Tube Sensor", Carnahan Conference, 1974.

Jan. 18, 2007 Harman; Southwest Microwave, Inc., "Intrepidtm A New Outdoor Perimeter Sensor Technology", Institute of Electrical & Electronics Engineers (IEEE) Magazine, 1984.

TRIBOELECTRIC, RANGING, OR DUAL USE SECURITY SENSOR CABLE AND METHOD OF MANUFACTURING SAME

FIELD OF THE INVENTION

The present invention relates to a security sensor cable. More particularly, the present invention relates to a triboelectric dual use sensor cable, whereby the selection of a particular dielectric material enhances the cable "sensitivity" and reduces manufacturing cost and processing complexity.

BACKGROUND OF THE INVENTION

Perimeter intrusion detection systems using linear detection cables can function based on a variety of physical sensing technologies such as RF leaky cable, guided radar, loose conductor active or passive cables, triboelectric or piezoelectric cables, fiber optic cables, electrostatic fields between conductors, etc. Generally they consist of sensor cables deployed along a line, and a processor to interrogate the cables, either active by sending a signal into the cable and assessing the response, or passive where a signal is received from the cable representing an intrusion. If the response output from the injected signal in active systems is received at the same cable end, and timing relative to the input signal is used, some systems described as "ranging" can perform an additional processing operation to determine the location of the intrusion along the cable linear axis.

The cost viability of such systems is generally assessed on the overall cost per meter of sensor length, which combines the per meter cost of the cables, and the number and cost of processors for the length. The most economical solution generally means large distances between inexpensive processors, and inexpensive cables. However the longer the cables, the more important it is to determine the location of intrusions along the cable. For example, a video camera can be used to assess an alarm and identify the source. This generally means one needs to situate and activate a camera by the sensor with distances less than 100 meters to visually assess the intrusion.

Competitive fence detection sensors can be classified generally into two groups. One group uses relatively complex and costly processing means to provide location information along long cables, and the other, more frequent simpler processors without location means. To be equally cost competitive, in the former case the cables can be more costly than the latter case as the processors are less frequent, while in the latter case both the cables and the processors must be inexpensive.

The perimeter intrusion detection systems are also generally classified either as passive sensing systems, as active sensing systems, or more recently as dual use sensing systems.

Existing cable based linear microphonic sensing systems may work passively, meaning a terminal voltage or charge is produced when the sensor cable is vibrated or deformed by an intruder in proximity. For example, the proprietary IntelliFLEX™ sensor, sold by Senstar-Stellar, uses a triboelectric effect sensor cable where a small cable terminal voltage is produced when the cable attached to the fence is vibrated, e.g. by an intruder climbing the fence to which the cable is attached. Other sensing means for cables may use the piezoelectric effect, or be based on magnetic materials.

However, there are also fiber optic systems such as IntelliFIBER™ or FiberSensys™, sold by Senstar-Stellar, that are active in that they transmit an optical signal, yet do not provide any location data as they receive a signal modified by a vibration from an intruder, at the opposite cable end. Processing of these signal changes is similar to the passive systems.

Active systems such as the INTREPID MicroPoint™ cable and detection system by Southwest Microwave use a special coaxial cable with loose conductor wires and electronics to detect and locate reflected signal changes from impedance changes produced along the cable. Many of these sensing cables are costly, either because of the materials used or the complexity of processes for construction. For example piezoelectric, triboelectric or electret coaxial cables generally use a special fluoropolymer dielectric material which generates or transfers a charge when flexed or vibrated. These fluoropolymer materials are both costly themselves on a per pound basis, and also more difficult to process compared to many other plastics, as they require high melt temperatures to process, or alternatively may have corrosive properties requiring specialized and costly extrusion equipment. Materials for some cables such as piezoelectric require heating, or stretching for "pre-charging" of the materials. This dielectric material may be extruded but sometimes is best handled by constructing a tape material that is subsequently installed on the cable center conductor by a slow winding process to create the cable dielectric. Electret sensing cables similarly use a production process to heat and charge a fluoropolymer material used for the dielectric. Sometimes the charging is done as a secondary process after the cable is manufactured.

In conventional commercial sensing cables, the piezoelectric cables yield the largest voltage response to a disturbance, with the electret being the weakest, and the triboelectric as an intermediary. Depending on the magnitude of the response relative to ambient noise, there may be a need for additional cable shielding and amplification or other means to improve signal to noise which would adversely affect cost.

Generally, the piezoelectric coaxial cables rely on the continuous contact between the piezoelectric dielectric and the inner and outer conductors for their function, whereas the commercial electret cable create a permanent charge on the dielectric of some polarity, but have an inherent looseness in the braid through its manufacture to allow modulation of a charged capacitor when the cable vibrates. (This is somewhat analogous to, for example, stroking a ferrous material for magnetization in the electret-magnetic arts.) The current commercial triboelectric coaxial cables are distinctive in requiring one of its conductors to be quite loose relative to the dielectric in order to transfer the charge.

Other cables use magnetic materials that again are difficult and costly to process. These magnetic cables require a loose conductor or a plurality of conductors in the dielectric. Even with a relatively complicated manufacturing process they are susceptible to field installation problems due to mishandling.

Fiber optic cables are generally simple in construction; however, they are relatively costly, and have an inherent complexity in processes for installing connectors between cables.

In the prior art literature and based on experiments it would appear that there is little technical distinction between electret and triboelectric principles in creating cables with a terminal voltage in response to a disturbance. The triboelectric series relates to both of these principles in selection of materials for sensitivity, and materials processing prior to manufacturing of cables can be employed to further affect the sensitivity of cables. For example, the same fluoropolymer materials can be used in creating electret, triboelectric, and piezoelectric cables, however it is not clearly understood in the art which component or components creates the voltage. Hence, it is important to have an understanding of how the electret, triboelectric, and piezoelectric charge properties are created.

An electret to create a permanent charge on a material can be formed generally by heating a dielectric close to its melting point, applying a strong electric field and then cooling the dielectric with the field still applied. The result is a residual charge with a lifetime dependent on the material, and it may go through an immediate polarity reversal. Electret processes can also use a corona discharge or an electron beam to produce the charge. However, while there is no clear definition in the art of the best electret materials, except that tetrafluoroethylene (Teflon™) and polyethylene terephtalete (Mylar™) film used commonly in microphone and ultrasonic applications are cited as useful plastics, as are certain ceramics and carnauba wax.

Piezoelectric materials are typically materials such as tetrafluoroethylene as well as other fluoropolymers. The piezoelectric properties are produced by simultaneously heating and applying an electrical field combined with some mechanical stress. Hence, it is possible to have a combination of three (or more) voltage or charge producing factors in some cables which use fluorocarbon dielectrics, for example. However, one distinguishing feature is that piezoelectric cables do not transfer charge through an air gap, but rather are generated by heating and stressing the dielectric. Triboelectric cables require a loose conductor/dielectric interface to transfer a charge.

It is also important to note that the process of creating these electrical charge properties can be prior, during or even accidental. What is meant by this statement is that one can apply heat, mechanical stress, or an electrical field, in a controlled manufacturing process or simply rely on an accidental result occurring in processing.

There are a number of background patents that discuss how to create electrets, which are similar to piezoelectrics as they relate to heating by applying a high direct current (DC) voltage of some polarity, and then providing a cooling process. For example, U.S. Pat. No. 3,316,620, issued to Stewart, describes in detail the process of creating a PVC electret. Other well known methods to create an electret include using a corona discharge. An Internet Encyclopedia on a world wide web site, energy21.org, provides an article, by Geoff Egel, entitled "Electrets vs Dielectric Absorbers" that states: "The list of different 'plastic' materials to experiment with is extensive, aside from the usual plexiglas, perspex, acrylic, epoxy, and glasses, [ . . . ]. All of which react differently when charged up, and all of which relate to the triboelectric charging principles—whereby some plastics are charged positive (donator) and some are negative (acceptor)."

Further discussion on the above topic is provided in the following references: "Electrostatics And Its Applications" by A. D. Moore (1973), pp 66; "Handbook of Electrostatic Discharge Controls" by Bernard S. Matisoff (1986), pp 16, "Understanding and Controlling Static Electricity" by G. Luttgens & M. Glor (1989), pp 44, and "Plastics for Electrical Insulation" by Paul F. Burns (1968), pp 50.

Triboelectric cables rely on the use of a combination of materials that are spaced apart on what is known in the art as the triboelectric series to achieve a potential difference. A looseness exists between these materials which then come into contact from a disturbance and frictionally transfer a charge from the triboelectric effect (moving surface interaction). The triboelectric effect is an electrical phenomenon where certain materials is electrically charged or transfers charge when coming into contact with another different material. Based on this electrical phenomenon, the triboelectric cables provide a suitable terminal voltage when flexed or vibrated locally. For example, cables, such as Intelli-FLEX™, have conventionally used tinned copper conductors with a fluoropolymer (FEP), such as Teflon™, as the dielectric material as it is known to have a high response to charge transfer. Unfortunately, using FEP materials mean cable costs are rather expensive when used for large distances based on their cost per meter length. It is also observed that other materials exist as close neighbors in this series and may have acceptable triboelectric properties for this use. These include for example polyvinyl chloride (PVC) and polyethylene.

PVC and polyethylene are common low cost cable materials widely used for cable insulation, most typically polyethylene for coaxial cable dielectrics and jacketing, and PVC for jacketing. Extrusion of these materials is also well known in the cable industry and relies on the simplest process equipment.

Other loose conductor cables may use a number of loosely disposed conductors in special keyways within the dielectric. However, these keyway conductors are relatively complicated to process and are susceptible to field installation problems if mishandled.

U.S. Pat. No. 2,787,784, issued to Meryman et al., on Apr. 2, 1957, discloses a triboelectric sensing device. The sensing device comprises a cable that is physically deformable to provide a triboelectric voltage and an amplifier operatively coupled to the cable to amplify the signal received from the cable in response to a disturbance to the cable. The cable itself consists of two conductive members, and a flexible deformable dielectric conduit loosely spaced between the conductive members. However, the Meryman et al. patent does not disclose the use of a particular dielectric material for the dielectric tubes to enhance the "sensitivity" of the cable, nor does it discuss an active ranging application of the cable. As there is no discussion of specific triboelectric materials, the Meryman et al. patent does not suggest using one material over another in the triboelectric series. The Meryman et al. patent disclosure is limited to a device consisting of a cable and signal amplification means.

In U.S. Pat. No. 3,763,482, issued to Burney et al., on Oct. 2, 1973, the patent discloses an electret coaxial cable for intrusion detection in security systems. This transducer cable comprises an inner conductor and an outer conductor, and a dielectric filler between the conductors where the filler comprises an electret. The cable operates based on the rate of change of position of the outer conductor relative to the cable interior to produce a detectable signal across the inner and outer conductors. Thus, there is an effective air gap between the outer conductor and the outer surface of the filler electret. The air gap creates a discontinuous contact between the outer conductor and the outer surface of the electret, which as a consequence allows the effective air gap to function as a dielectric layer between adjacent faces of the outer conductor and the electret, forming therewith a capacitor. The capacitance level changes as a result of deformation to the cable. A static charge created at the point of deformation is then modulated along the line to produce a detectable signal which is then recorded. The use of materials such as polycarbonate and tetrafluoroethylene (Teflon™) are taught to make the cable highly desirable as they provide a longer charge life than other materials.

Burney et al. further discusses the manufacturing of the co-axial cable with the Teflon™ filler as highly desirable due to its widespread availability. However, Burney et al. does not disclose an active use of the sensing cable. Furthermore, the Burney et al. patent does not disclose a loose center conductor construction. Rather, the looseness is between the dielectric tube and the outer conductor. While the Burney et al. patent does suggest using certain materials due in part to their commercial availability, the selection of filler material is related to their electret properties and as such, materials in the triboelectric series are not specifically discussed in this patent.

U.S. Pat. No. 3,846,780, issued to Gilcher, on Nov. 5, 1974, discloses an intrusion detection system and a cable having an insulated electrical wire loosely positioned within an electrically conductive tube member having an inside diameter substantially greater than the diameter of the wire. This "passive" sensing system utilizes the loose dielectric coated wire in the conductive tube to sense disturbances via the electret effect, or by sensing capacitive changes when there is a DC bias voltage applied to the dielectric coated wire. The Gilcher patent discloses the use of a Teflon™ coated electrical conductor as the preferred dielectric material. Gilcher teaches the use of the clear insulated Teflon™ wire as being better for detecting devices utilizing the electret characteristics of the cable. While PVC was also tested, the material recommended by Gilcher was Teflon™. The Gilcher patent also does not disclose the use of the sensor cable in an active system.

U.S. Pat. No. 4,197,529, issued to Ramstedt et al., on Apr. 8, 1980, discloses a very particular cable configuration comprising an inner metallic conductor centered about the axis of the cable, a thin, substantially flat, horizontal sheet of insulating material, disposed parallel to the horizontal center line which makes contact with and supports the center conductor, and an outer metallic sheath which encloses the conductor and the horizontal sheet. The Ramstedt et al. patent also discloses the cable as part of an intrusion detection system having means for terminating the cable in its characteristic impedance and means connected to the cable for injecting a pulse into the cable which propagates to the end terminating in the characteristic impedance. When an intrusion causes a cable disturbance, the system measures a reflected pulse to determine the location of an intrusion. The Ramstedt patent also discloses that the unique cable design advantageously provides greater sensitivity to motion and vibration. However, this cable construction is rather complex in terms of manufacturing processes and, therefore, not practical cost-wise for applications having larger distances. While the Ramstedt patent discloses an active sensing function, there is no discussion of this particular sensor cable having application for passive sensing by triboelectric effect.

U.S. Pat. No. 5,448,222, issued to Harman, on Aug. 29, 1995, discloses teachings directed towards a transducer cable for detecting the location of a sensed disturbance. According to Harman, the transducer cable contains a center conductor, an outer conductor, a dielectric material between the outer and the center conductor, and a "floating" sense wire conductor located in a slot formed in the dielectric material. While a disturbance of the cable causes the sense wire to move relative to the outer conductor, the sense wire is not constructed as a loosely centered conductor. Rather, Harman primarily teaches a dual slot conductor configuration whereby both the center conductor and the sense wire form a first transmission line and the outer conductor and the sense wire form a second transmission line. A "driving" signal is imposed on the transducer cable in order to obtain a response signal. According to Harman, the location of the intruder is determined from the detected response signal. Harman also teaches a "floating" center conductor, however, the teaching is limited to the center conductor being free to move. While Harman teaches the use of polyethylene as a possible dielectric material, the selection of material to enhance the "sensitivity" of the cable in a passive function is not disclosed. The slot also adds a level of complexity and therefore cost to the manufacture of the cable. Finally, Harman teaches away from triboelectric sensing cables by suggesting their performance is inconsistent from cable to cable.

U.S. Pat. No. 5,705,984, issued to Wilson, on Jan. 6, 1998, discloses an intrusion detection system that provides an active sensing cable whereby multiple simultaneous intrusions may be detected along the cable. Wilson teaches an RF transmission cable that has first and second conductors spaced apart with an insulating material. Wilson further teaches that the cable has a characteristic impedance throughout its length that at any point can change in response to a change in the spacing of the conductors. The cable is buried at a depth that enables the spacing change to occur in response to weight applied proximate to the buried cable. A transmitter provided in the intrusion detection system directs electrical energy into one end of the transmission cable. A portion of that electrical energy is reflected back from any point in the cable that has an impedance that differs from the characteristic impedance. The intrusion detection system utilizes a reflectometer circuit connected to the cable for producing an indication that an intrusion has occurred and the specific location of that intrusion in response to the reflected energy. The system also includes a transfer circuit to separate the transmitted RF energy from the reflected energy. In practice, Wilson teaches that this transfer circuit will be a directional coupler or a similar device known in the art. However, Wilson does not disclose a sensor cable having dual use for both a passive and an active ranging cable system, as the cable construction does not provide a loose center conductor.

There is a need to overcome the shortcomings of the prior art as none of these references disclose nor teach the selection of triboelectric materials, such as polyethylene or other similar material, for enhancing the "sensitivity" of the sensor cable in response to a disturbance or improving their cost effectiveness. Moreover, while several background patents teach various sensing cable constructions, a simple and cost-effective manufacturing process is not contemplated in any of the prior art teachings.

While the Burney '482 patent provides an electret cable that has a loose dielectric similar to triboelectric cables, it requires some electret charging processing in its manufacture. Similarly, the Gilcher '780 patent discloses an electret cable that has a loose conductor but relies on the inherent electret properties of coated wire materials. Manufacturing processes using electrical testing such as dc "hi-pot" testing can deliberately or inadvertently create electret sensitized cables so it is difficult to determine what is the inherent signal level of a specific material created by processing. For example, a strong charge develops on the Intelli-FLEX™ cable after dragging it along the ground. It is possible that extrusion processes, with the plastic still molten or softened, could cause electrification.

In sum, there is a need with existing or planned cables to either optimize or control the processing in manufacture, and later their use, to ensure whatever electrical charge properties are created and maintained for stability purposes.

The stability of the sensor cable response may also vary with the material used and the environmental conditions, i.e., temperature changes, mechanical and electrical stress applied, and humidity level changes. Therefore, the present invention seeks to provide an economic cable that is sufficiently stable within its environment and can be manufactured with low cost materials and simple processes to provide a suitable terminal voltage response to a disturbance.

SUMMARY OF INVENTION

An object of this invention is to provide a cable that utilizes both low cost materials and conventional manufacturing cable processes to make a simple, inexpensive sensor cable to therefore minimize the cost of this component in either passive, active, or dual use intrusion detection systems.

The present invention relates to an inexpensive security sensor cable, a method for manufacturing of same and an overall security system for using that sensor cable. The sensor cable consists of a central conductor, an air dielectric separator, a polyethylene dielectric tube, an outer conductor and an outer protective jacket. The central conductor is loosely centered in the coaxial cable and thus freely movable relative to the dielectric tube. The sensor cable has application either in a passive sensing system or in an active ranging sensing system to determine the location of an intrusion along the cable. For the passive sensing function, when the center conductor moves, it contacts a suitable dielectric material from the triboelectric series, such as a polyethylene dielectric tube, to produce a charge transfer by triboelectric or electret effect that is measurable as a terminal voltage.

In an active system, a signal pulse is transmitted into the sensor cable by a reflectometer, for example, coupled to the cable. When an intrusion disturbs the sensor cable, the central conductor moves within the dielectric in response to the vibration at that location to provide an impedance change that can be sensed. Accordingly, the reflection of the signal pulse is altered and a measurement of the reflection by the reflectometer provides timing information to identify the location of the disturbance. The magnitude or frequency response of the reflected signal may of course also be used to detect or classify the presence of the intrusion. Other processing systems may also be utilized to monitor the reflection of the signal pulses and sense intrusion along the sensor cable.

One advantage of the present invention is it is based on conventional cables, such as RG-62U cable well-known for computer and communication application. The standard RG-62U cable is typically constructed to provide a central conductor of copper-clad steel around which is wound a polyester thread dielectric at a prescribed pitch angle. Around this thread is extruded a further solid polyethylene dielectric tube. An outer conductor or shield of braided copper strands surround the dielectric tube. Finally, a protective outer jacket made of polyvinyl chloride (PVC) or polyethylene is extruded to surround the outer conductor. The combination of the polyester thread and the dielectric tube provide a central conductor that is fixed in place relative to the outer conductor.

In the preferred embodiment of the present invention, such conventional RG-62U cable is modified in its construction by omitting the polyester thread, making it threadless. In terms of manufacturing, this sensor cable can be easily constructed using the same or similar processes of extrusion, braiding and jacketing, as well as the same common communication cable components. By eliminating the inner thread in the sensor cable, the center conductor is free to move in the air gap within the dielectric tube, preferably of polyethylene material. Accordingly, the present invention provides an inexpensive method of manufacturing a sensor cable, as the cable parts are readily available and the prior art manufacturing processes are simple and readily available.

Such a sensor cable is advantageous in that the passive triboelectric properties of the cable, in response to a disturbance, provide a larger voltage response over known cables such as the Intelli-FLEX™ cable which use a more expensive material with a higher dielectric constant. The voltage response to a known disturbance is referred to hereinafter as representing the "sensitivity" of the cable.

It is also understood that the dielectric material chosen is not limited to polyethylene as materials such as PVC, or foamed polyethylene may be used. In addition, both the passive and the active applications of the cable advantageously provide an inexpensive "dual use" cable for intrusion detection systems.

Similarly it is understood that manufacturing controls or processing of the material may be employed to enhance the sensitivity or improve signal to noise, such as by creating or maintaining an electret charge.

In a first aspect, the present invention provides a sensor cable for use in an intrusion detection system having a processor, the sensor cable having an input and an output, both the input and the output of the sensor cable for coupling to the processor, the sensor cable comprising:

a first electrically conductive cable member;

a second electrically conductive cable member;

an air separator and a plastic electrically insulating member both being disposed between the first conductive cable member and the second conductive cable member;

the first electrically conductive cable member having one surface in contact with the air separator and being freely movable within the air separator relative to the plastic electrically insulating member; and the plastic electrically insulating member being made of a material selected based on triboelectric series properties and being processed such that the cable is capable of producing a terminal voltage with acceptable signal to noise in response to a disturbance.

In a second aspect, the present invention provides an integrated sensor cable for use in an intrusion detection system having a processor, the sensor cable having an input and an output, both the input and the output of the sensor cable for coupling to the processor, the integrated sensor cable comprising:

a first electrically conductive cable member;

a second electrically conductive cable member;

an air separator and an plastic electrically insulating member both being disposed between the first conductive cable member and the second conductive cable member;

the first electrically conductive cable member having one surface in contact with the air separator and being freely movable within the air separator relative to the plastic electrically insulating member, to provide an impedance change in response to a disturbance; and the plastic electrically insulating member being made of a material selected based on triboelectric series properties and being processed such that the cable is capable of producing a terminal voltage with acceptable signal to noise in response to the disturbance.

In a third aspect, the present invention provides a method of manufacturing an integrated sensor cable for use with an intrusion detection system, comprising steps of:

a) selecting materials for construction of a coaxial cable, the coaxial cable having a first electrically conductive cable member, a second electrically conductive cable member, and an air separator, a threaded member, and an plastic electrically insulating member, the air separator, the threaded member, and the plastic electrically insulating member being disposed between the first conductive cable member and the second conductive cable member, and the threaded member being wound around the first cable member to prevent movement of the first cable member within the air separator, relative to the insulating member; and b) altering the construction to omit the threaded member from the manufacturing method to form a threadless coaxial cable, the first electrically conductive cable member having one surface in contact with the air separator and being freely movable within the air separator relative to the plastic electrically insulating member, and the plastic electrically insulating member being made of a material having suitable triboelectric series properties and being processed such that the threadless coaxial cable is capable of producing a terminal voltage with acceptable signal to noise in response to a disturbance.

In a fourth aspect, the present invention provides a method of manufacturing an integrated sensor cable for use with an intrusion detection system, comprising steps of:

a) selecting materials for construction of a coaxial cable, the coaxial cable having a first electrically conductive cable member, a second electrically conductive cable member, and an air separator, a threaded member, and an plastic electrically insulating member, the air separator, the threaded member, and the plastic electrically insulating member being disposed between the first conductive cable member and the second conductive cable member, and the threaded member being wound around the first cable member to prevent movement of the first cable member within the air separator, relative to the insulating member; and b) altering the construction to omit the threaded member from the manufacturing method to form a threadless coaxial cable, the first electrically conductive cable member having one surface in contact with the air separator and being freely movable within the air separator relative to the plastic electrically insulating member, to provide an impedance change in response to a disturbance, and the plastic electrically insulating member being made of a material having suitable triboelectric series properties and being processed such that the dethreaded coaxial cable is capable of producing a terminal voltage with acceptable signal to noise in response to the disturbance.

In a fifth aspect, the present invention provides a passive intrusion detection system comprising:

a cable having a first electrically conductive cable member, a second electrically conductive cable member, and an air separator and an plastic electrically insulating member both being disposed between the first conductive cable member and the second conductive cable member, the first electrically conductive cable member having one surface in contact with the air separator and being freely movable within the air separator relative to the plastic electrically insulating member, and the plastic electrically insulating member being made of a material selected based on triboelectric series properties, and being processed such that the coaxial cable is capable of producing a terminal voltage with acceptable signal to noise in response to a disturbance; and a processor, operatively coupled to the cable, for generating a signal in response to the terminal voltage produced from the cable in order to detect the disturbance.

In a sixth aspect, the present invention provides an active intrusion detection system comprising:

a cable having a first electrically conductive cable member, a second electrically conductive cable member, and an air separator and an plastic electrically insulating member both being disposed between the first conductive cable member and the second conductive cable member, the first electrically conductive cable member having one surface in contact with the air separator and being freely movable within the air separator relative to the plastic electrically insulating member, to provide an impedance change in response to a disturbance, and the plastic electrically insulating member being made of a material selected based on triboelectric series properties such that the cable is capable of producing a terminal voltage with acceptable signal to noise in response to the disturbance; and a processor, operatively coupled to the cable, for propagating an injected signal into the cable and receiving a reflected signal altered by the impedance change along the cable, and locating the disturbance based on a timing differential between the reflected signal relative and the injected signal.

In a seventh aspect, the present invention provides an intrusion detection system comprising:

a cable having a first electrically conductive cable member, a second electrically conductive cable member, and an air separator and an plastic electrically insulating member both being disposed between the first conductive cable member and the second conductive cable member, the first electrically conductive cable member having one surface in contact with the air separator and being freely movable within the air separator relative to the plastic electrically insulating member, to provide an impedance change in response to a disturbance, and the plastic electrically insulating member being made of a material selected based on triboelectric series properties and being processed such that the cable is capable of producing a terminal voltage with acceptable signal to noise in response to the disturbance; and a processor, operatively coupled to the cable, for propagating, in an active state, an injected signal into the cable and receiving a reflected signal altered by the impedance change along the cable, and locating the disturbance based on a timing differential, and for generating a signal, in a passive state, in response to the terminal voltage produced from the cable in order to detect the disturbance.

BRIEF DESCRIPTION OF THE DRAWINGS

The present invention will now be described with reference to drawings, in which.

DETAILED DESCRIPTION OF THE INVENTION

Figure 1:
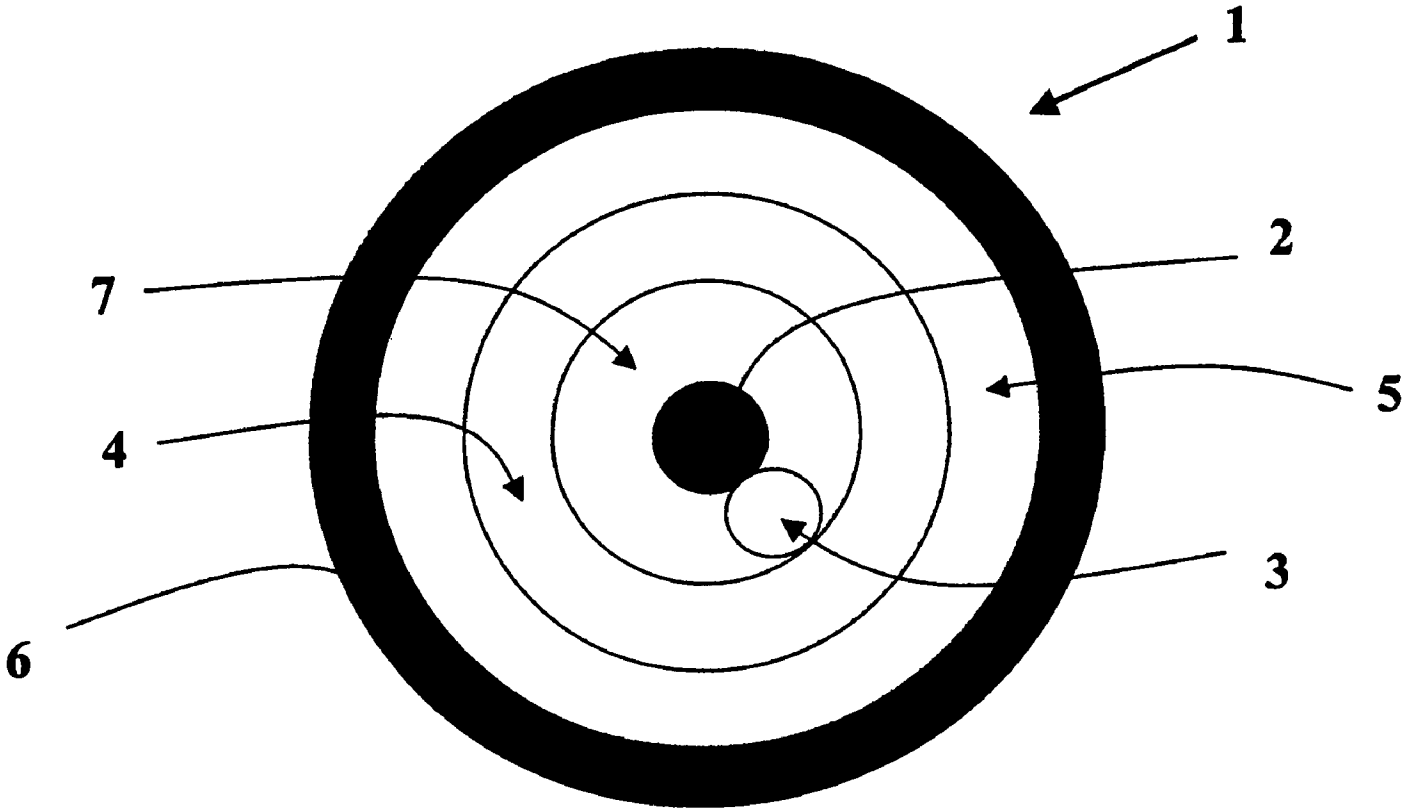
FIGURE 1 PRIOR ART
FIG. 1 is an end view of a conventional cable for computer and communication applications of the prior art.

The invention will be described for the purposes of illustration only in connection with certain embodiments. However, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

For the purposes of this document, the "active ranging" cable system is one where a signal is injected (transmitted) into the cable, and a response signal, either unmodified or modified by an intruder, is sensed by a receiver and analyzed by a processor to determine presence and location (range) of the intrusion, similar to radar. For example, the injected signal to a loosely disposed conductor cable could be a pulse, and the reflected signal from an intruder altering the impedance of the cable is captured at the same cable end and analyzed; e.g., time relative to the input pulse is used to obtain location, signal amplitude or frequency (spectrum) to classify the intruder as a valid target.

Also for the purposes of this document, in a "passive" cable system, there is no signal injected by a transmitter, rather it is created on the sensor cable itself by the disturbance, such as in triboelectric, piezoelectric and electret cables.

The signal is received and analyzed as a generally continuous time response waveform of some amplitude and frequency—there is no timing data relative to an injected signal to provide location. For example with the Intelli-FLEX™ system the sensor cable is constructed with suitable materials having triboelectric properties, to produce a small voltage between inner and outer conductors in response to local cable flexing, from the presence of the intruder.

It is also understood that the classification of "passive, or passive sensing, or passive disturbance sensing" systems includes those cable systems that require some excitation signal applied to the sensing cable to provide the passive sensing signal to analyze. These systems as such do not generate a voltage signal on their own, being for example magnetic or fiber optic cables.

For example with the IntelliFIBER™ system, a signal input is a continuous optical signal applied at one end of the fiber cable. The system receives a signal at the other end of the fiber cable which has its polarization altered by the intruder's presence. The optical output signal is converted to a voltage response very similar to the passive sensed output of the Intelli-FLEX™ sensor. This system does not provide location data, as there is no timing element nor reflection data provided with sensing at the opposite cable end. Accordingly, the present invention may be incorporated into such a system, as a passive sensing system with a converted voltage output relative to the disturbance.

Referring now to FIG. 1, an end view of a conventional cable 1 well known in the art for computer and communication applications, such as the RG 62U cable is illustrated. This prior art cable 1 is constructed to provide a mixed dielectric of a combination of air and several plastic grades. This dielectric combination is termed semi-solid. The center conductor 2 is typically copper clad steel, around which is wound a polyester thread 3 at a prescribed pitch angle. Around this thread 3 is next extruded a further solid polyethylene dielectric tube 4. Following this an outer conductor 5 or shield of copper strands is braided along the dielectric tube 4. This outer conductor 5 may be impregnated with a water blocking material such as a silicone grease or wax to reduce the risk of moisture propagation internally if the cable 1 is damaged. Finally an outer jacket 6 made of material such as PVC or polyethylene is extruded. Hence, the dielectric elements between the center and outer conductor is a combination of the helical air gap 7, the polyester thread 3 and the polyethylene tube 4. The dimensions of each dielectric 3, 4, 7 are selected to provide a particular velocity of propagation of the cable, and a nominal impedance. The combination of the thread 3 and the tube 4 fix the center conductor 2 in place relative to the outer conductor 5.

Figure 2:
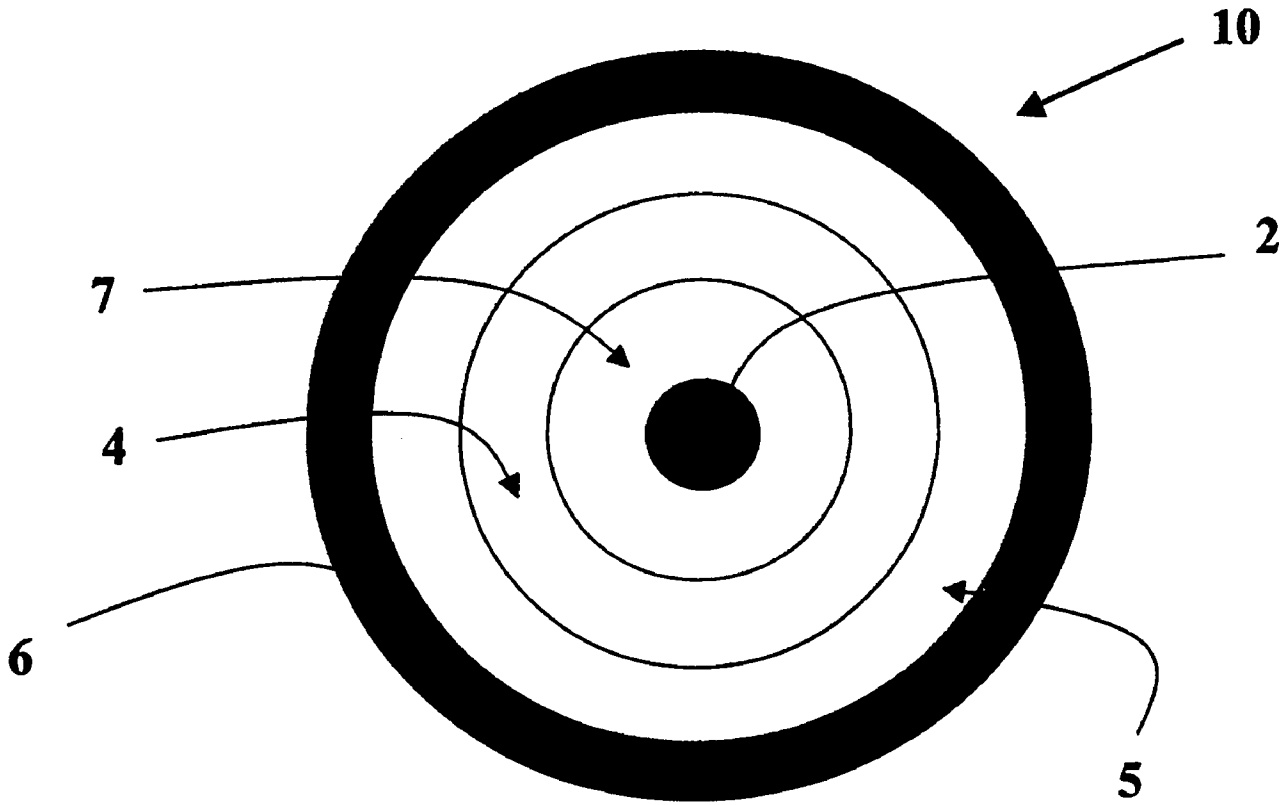
FIG. 2 is an end view of a sensor cable constructed and manufactured according to a first embodiment of the present invention.

FIG. 2 illustrates an end view of a sensor cable 10 constructed and manufactured according to an embodiment of the present invention. This sensor cable 10 consists essentially of a conventional threaded cable modified to include as a minimum two dielectric materials, namely a polyethylene dielectric tube 4 which can be of the same inner and outer dimensions as the RG-62 cable for example, and an inner air gap 7 with the center conductor 2 free to move in the space between. The sensor cable 10 can be relatively easily constructed using the same or similar processes of extrusion, braiding and jacketing as the well known communications cable. As the inner thread is not utilized in the cable construction of the sensor cable 10, the center conductor 2 is free to move in the inner air gap 7 within the polyethylene tube 4. The sensor cable 10 also uses the same materials as in the conventional cable, namely inexpensive polyethylene already used in volume for communication cables.

The dielectric material selected may also be foamed polyethylene, for example, or a triboelectric material close in ranking along the series.

For the passive triboelectric sensing function, the center conductor 2 is free to move in response to a vibration, which causes the center conductor to move into contact with a suitable dielectric material, such as polyethylene from the triboelectric series, to provide a charge transfer. In passive operation, experimental tests have shown that the selection of polyethylene enhances the "sensitivity" of the sensor cable of the present invention, i.e. terminal voltage produced between the conductors is higher relative to other conventional materials, such as FEP. Thus, the selection of dielectric material is based on producing a terminal voltage response that provides an acceptable signal to noise ratio.

It is understood that an "acceptable" signal to noise ratio is an order of magnitude (e.g. 10×) or more than the average noise, and that the minimum ratio would likely be a factor of 2.

For the active ranging function, the same conductor moves within the dielectric in response to a vibration, to provide an impedance change that can be sensed by conventional time domain ranging (TDR) processes, or by alternative processing means.

It is understood that the selection of suitable dielectric material is an important factor in enhancing the "sensitivity" of the sensor cable in response to a disturbance. However, the level of "sensitivity" of the sensor cable may be affected by various processes. Experimental tests were performed to test various combinations of dielectric and conductive materials. For example, a 5' sensor cable sample, constructed based on a modified RG-62 cable and heated to its dielectric softening temperature of approximately 80° C. for at least 24 hours, substantially diminished its sensitivity. However, other tests performed on similar triboelectric (electret) cable samples for example applying high alternating current (AC) voltages did not affect the stability of the cable samples' detection properties.

While FIG. 2 shows a fitted outer conductor 5, it is readily understood by the skilled artisan that this outer conductor 5 may have one surface in contact with an air separator located between the outer jacket 6 and the dielectric tube 4 as an alternative to a loose center conductor within a dielectric. This alternative construction enables the outer conductor 5 to move freely between the outer jacket 6 and the dielectric tube 4. For example, a conventional PVC tubing dielectric within a loose solid copper pipe as the outer conductor and a loose inner conductor was as effective as the RG-62 modified sensor cable embodiment of FIG. 2. Other standard hook-up wire with either tetrafluoroethylene or PVC coating (solid or stranded wire) within a loose outer conductor were also stable alternatives.

Other variant type cables, rather than a variation of RG 62 cable could be used to create the same function. For example "plenum rated" RG type cables exist with a similar "thread in tube" construction, but employ more costly FEP materials, and as such these materials are typically required and used for indoor applications. Constructing a new sensor cable based on an air gap in place of the thread in contact with the inner conductor would provide a similar dual security use. It is also understood that this variant of the sensor cable of the present invention may be more useful for indoor sensing applications.

Other suitable security cables can be constructed to the equivalent dimensions and using the same or similar materials, "bottom up" from conventional cabling processes, rather than as design variants of existing cables. For example, in cable construction there may be further variations, such as a different air gap about the central conductor to affect detection sensitivity, or a stranded center conductor to enhance cable flexibility.

It is understood by the skilled artisan that, for example, the sensor cable of the present invention could be optimized by modifying the center conductor wire, its size, and type; the dielectric tube; and shield, braided or foil. Based on experimental results, it has also been determined that the present invention could have multiple dielectric layers, for example the center conductor could be a coated wire as discussed further with reference to FIG. 3. The sensor cable might alternatively have a smaller dielectric thread loosely disposed on the tube.

Figure 3:
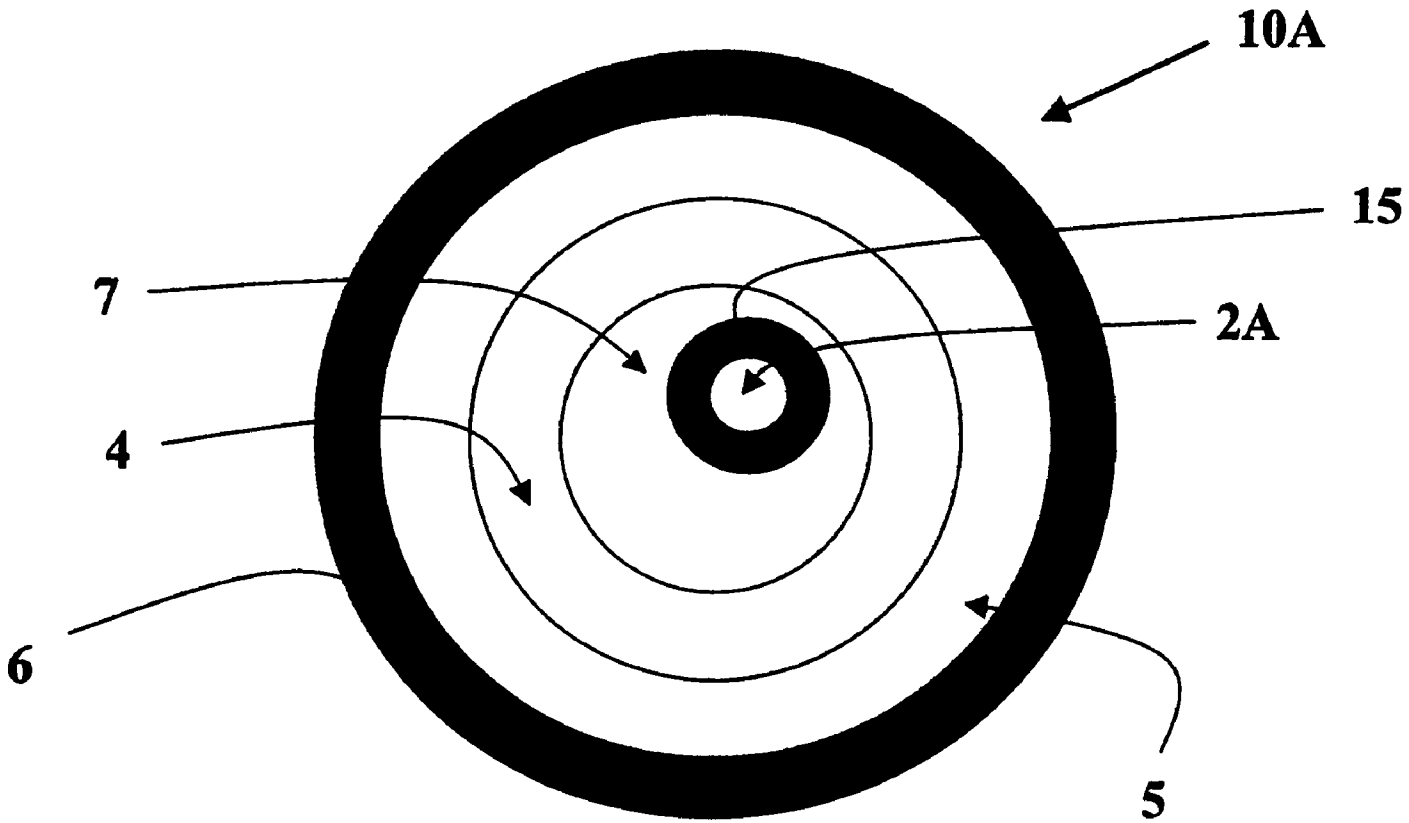
FIG. 3 is an end view of a sensor cable constructed and manufactured according to a second embodiment of the present invention.

FIG. 3 is an view of a sensor cable 10A constructed and manufactured according to a second embodiment of the present invention. The sensor cable 10A shown has a similar construction to that of FIG. 2 with the exception of a thin dielectric layer 15 coated on the center conductor 2A. As is well understood by the skilled artisan, coated conductors are usually form using a thin dielectric layer with material, such as Teflon™. Other dielectric coatings such as PVC are also possible. With this construction the looseness is between the two plastic dielectric layers 15 and 4.

Figure 4:
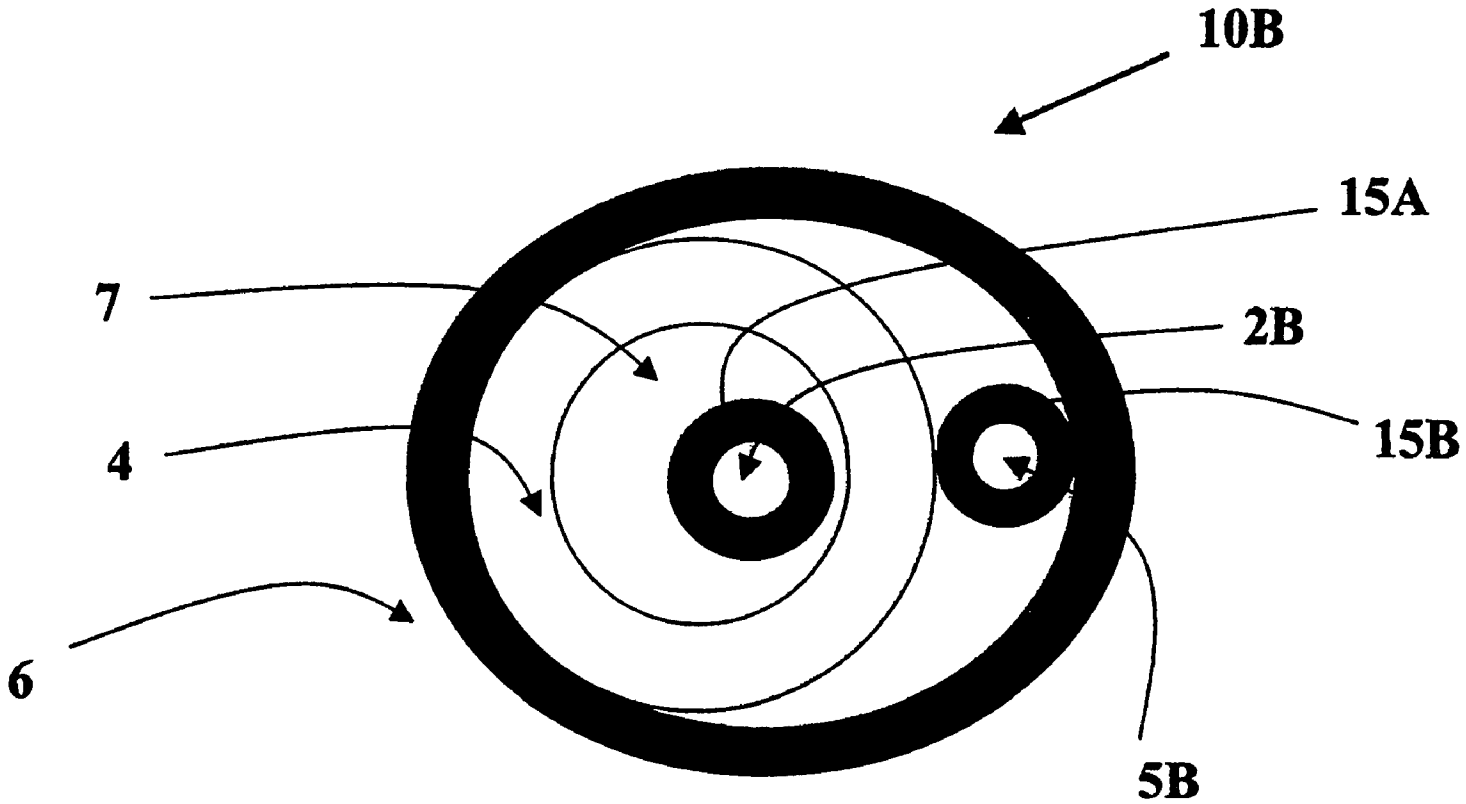
FIG. 4 is an end view of a sensor cable constructed and manufactured according to a third embodiment of the present invention.

Another alternative is a twisted pair cable construction, for example, where separate dielectric coated wires are twisted together and possibly shielded. FIG. 4 is an view of a sensor cable 10B constructed and manufactured according to a third embodiment of the present invention. The sensor cable 10B consists of a first conductive member 2B coated with a first dielectric layer 15B and loosely disposed within a dielectric tube 4 to move freely within an inner air gap 7, and a second conductive member 5B coated with a second dielectric layer 15B and twisted with the dielectric tube 4. While the two conductive members 2B and 5B are coated with corresponding dielectric layer 15A and 15B, it is readily understood that the dielectric coating may be omitted from the sensor cable construction. It is further readily understood that other cases such as dielectric 4 could be omitted as long as one of the two or more conductors is dielectric coated or jacketed.

For example, a standard category 5 (CAT5) twisted pair cable with 4 pairs is a possible cable construction, where generally each conductor has a dielectric jacket and then two of these are twisted together to create a pair. The number of pairs is variable based on need, and the overall jacket may have a metallic shield underneath; e.g. shielded twisted pair cable, or each pair may further have its own shield.

Figure 5:
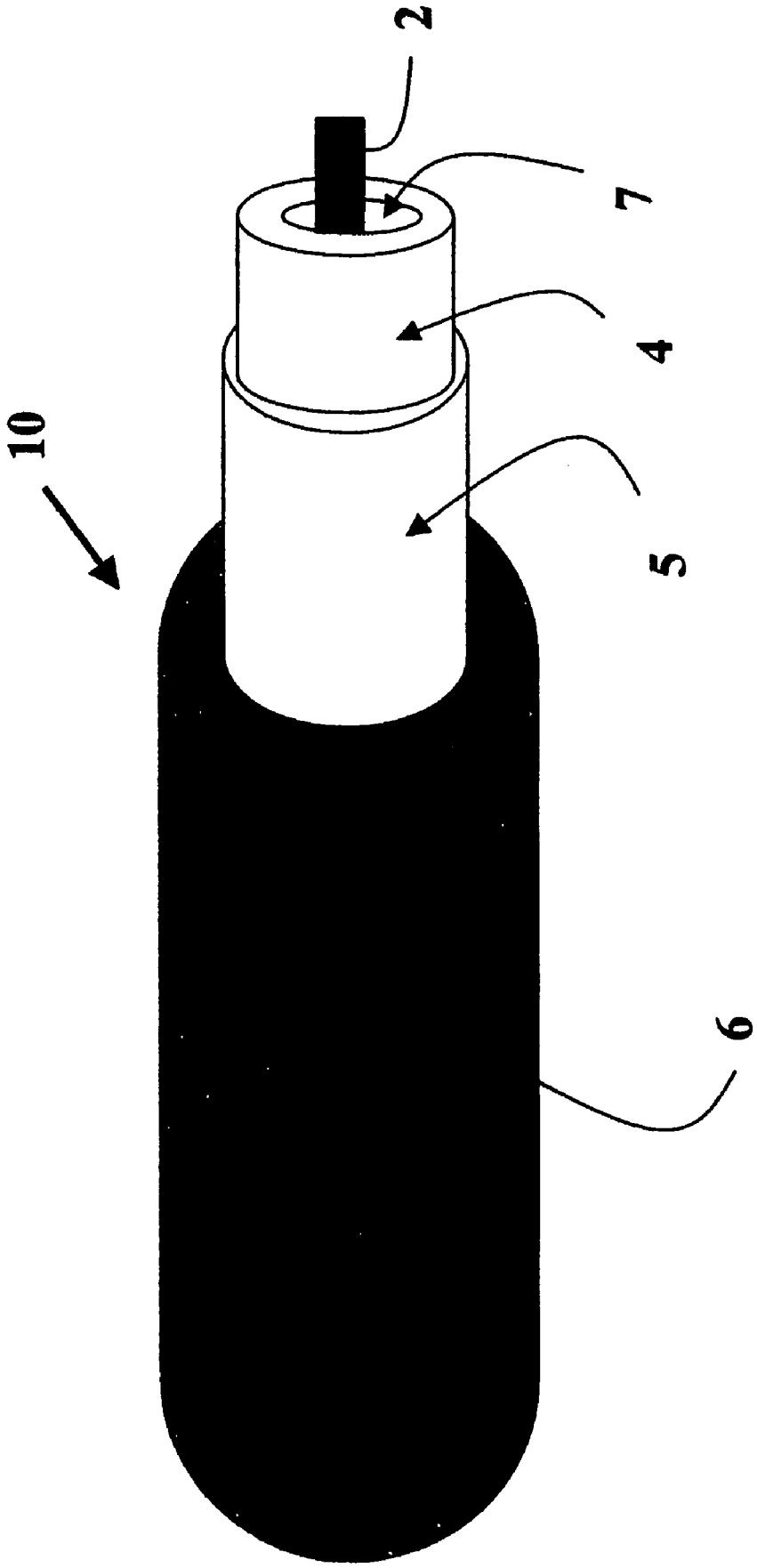
FIG. 5 is a side view of the sensor cable in FIG. 2.

FIG. 5 shows a side view of the sensor cable 10 of the present invention, which may be optimized for dual use as a sensor cable 10 for ranging purposes. As shown the outer tube 4 loosely encloses the center conductor 2, the outer tube 4 has an inner diameter larger than the outer diameter of the center conductor 2. The cable jacket 6 may be made of polyester elastomer, or any other suitable material. The coaxial cable outer conductor protective shield 5 may be made of tinned braided copper strands for electrical isolation purposes, or such strands in combination with a metallic foil layer or any other suitable electrical conductor. The centre conductor 2 may be any suitable conductor, such as tin-plated copper strands. For the passive use of the triboelectric sensor cable 10, the dielectric outer tube 4 and inner sense conductor 2 are selected based on their triboelectric properties and processes, i.e. manufacturing or handling. For the active ranging function, the sensor cable 10 is optimized according to the present invention for movement of the center conductor 2 in the tube 4 so that there is an adequate change in the capacitance, and hence impedance at the point where there is a disturbance.

The "processes" that determine the selection of dielectric include controlling the manufacturing process of the dielectric materials, or cable, to provide a consistent desired terminal response to a stimulus, or using specific means for electrically/mechanically optimizing the dielectric properties of the selected material by heating, dc or ac hi-pot charging, discharging, etc. While the sensor cable of the present invention does not require any special processing, any processes involved in manufacturing the dielectric material(s) should be consistently controlled.

An alternative construction is possible where the outer conductive member 5 could be a loose conductive cable member relative to the insulating outer tube 4, whereas the center conductor 2 is not free to move relative to the outer tube 4. Alternatively, it is possible that the tube 4 be "floating", loosely disposed between both conductive members 2 and 5.

Figure 6:
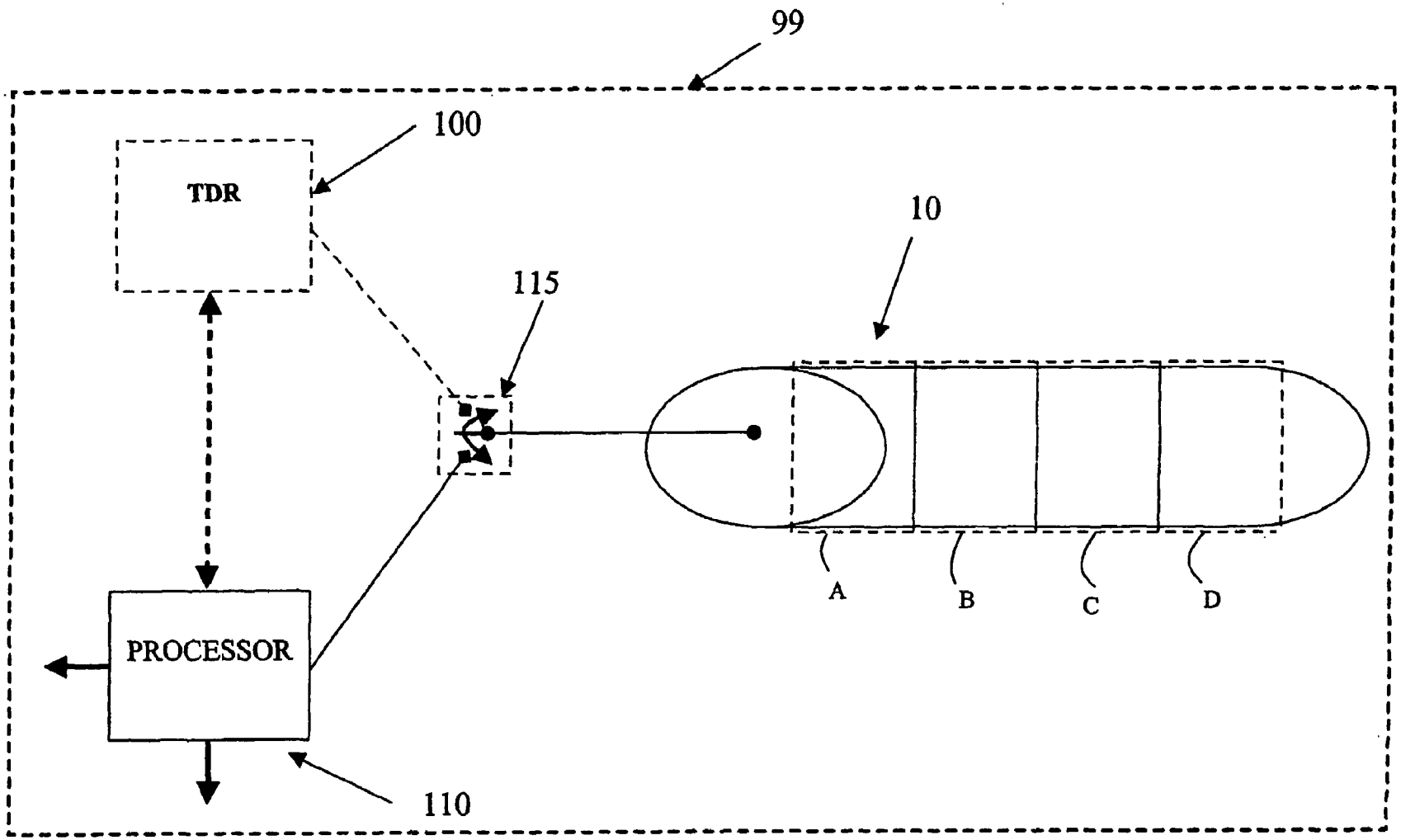
FIG. 6 is a block diagram of a sensor cable system including a sensor cable of the present invention for both passive and active intrusion detection along the length of the sensor cable.

A reflectometer may be coupled to the sensor cable 10, such as the Time Domain Reflectometer (TDR) 100 shown in FIG. 6, which can measure the change in impedance as a function of time as it can be synchronized to be directly proportional to the distance along the sensor cable 10.

In this embodiment, the function of the TDR is to interrogate the cable by propagating a pulse down the cable. When the pulse reaches an impedance change along the cable, a portion or all of the pulse energy is reflected back dependent on the size of the impedance change from the cable's characteristic impedance. The TDR measures the time it takes to travel down the cable to the disturbance where the impedance change occurs, and back along the cable. The TDR then forwards the reflected signal information to a processor or to a display. This implementation of the TDR, coupled to a sensor cable, is in an "active" state to provide an "active ranging" cable system. Alternatively, a cable may be coupled to a processor in a "passive" state to provide a "passive" cable system. In a "passive" state, the processor would measure a voltage change, with appropriate additional circuitry in some cases, as a time response function generated on the cable in response to a disturbance. In an embodiment of the present invention, both the passive cable system and the active cable system may be integrated to provide both the passive and the active states of cable sensing.

In FIG. 6, an intrusion detection system 99 of the present invention utilizes a Time Domain Reflectometer (TDR) 100, or a reflectometry unit, to inject a signal into the sensor cable 10 in order to determine the location of the intrusion based on the timing of the reflection of the injected signal. The system 99 shown in FIG. 6 utilizes an optional switch means 115 for a discrete time switching approach where the TDR 100 inputs a voltage (pulse) down the sensor cable 10 and receives a reflection, whereas a processor 110 is passively sensing a voltage output in a time sequence. The sensor cable 10, comprising a loosely disposed conductor and triboelectric construction, will cause both a triboelectric charge transfer, and an impedance change, when an intrusion occurs. The triboelectric charge change is sensed by a system processor 110 whereas the impedance change is sensed by the TDR 100. The time differential relative to the reflection from the impedance change provides the range to the disturbance along the sensor cable 10.

Further in FIG. 6, the intrusion detection system 99 provides a dual functionality on a single coaxial cable, which forms the sensor cable 10, in that the processor 110 can passively sense a disturbance based on a voltage generated, while the TDR 100 may actively sense the reflected pulse along the sensor cable 10. The triboelectric voltage generated on the sensor cable 10 in response to the disturbance can be measured and processed similar to a conventional passive sensor system. Both the active state and the passive state of cable sensing can also be executed in a chosen alternating time sequence by processor control of the switch means 115.

In this implementation of the present invention, a further consideration is thresholding and zoning for determining the presence and location of an intruder. For example, it may be useful to electronically define zones or range bins, that correspond to features of the perimeter where the cable is deployed, such as corners of buildings or gates, in order to activate video assessment or response forces. These zones, or a subset of these zones, may have respective detection thresholds set by a calibration procedure, for example, setting a low threshold in an area where the intruder detection is low (e.g., a very stiff fence), or high for a fence section that provides a large intrusion response.

As shown in FIG. 6, if processing is based on the time response, the sensor cable 10 may be divided electronically into zones or range bins. For example the sensor cable 10 is divided into four zones A, B, C, and D. Each zone is assigned a particular range such that the reflectometer attributes the location of the disturbance based on the zone in which the disturbance is detected.

Processor 110 can be either a time or frequency domain processor 110 in order to perform the dual functionality of detection and location within one processor having an integrated transmitter/receiver unit (not shown). Thus, the TDR 100, as a separate unit, is not required in the intrusion detection system 99 but instead its function can be integrated into the processor 110. The TDR function generally encompasses a method of creating a pulse, injecting it into the cable, and receiving and processing the time-response reflected signal from a cable to monitor signal changes as a function of distance. Thus, the processor 110 could utilize, for example, a directional coupler for separating the transmitted and reflected signals, or a reflection bridge, dependent on the type of signals injected and the application.

Figure 7:
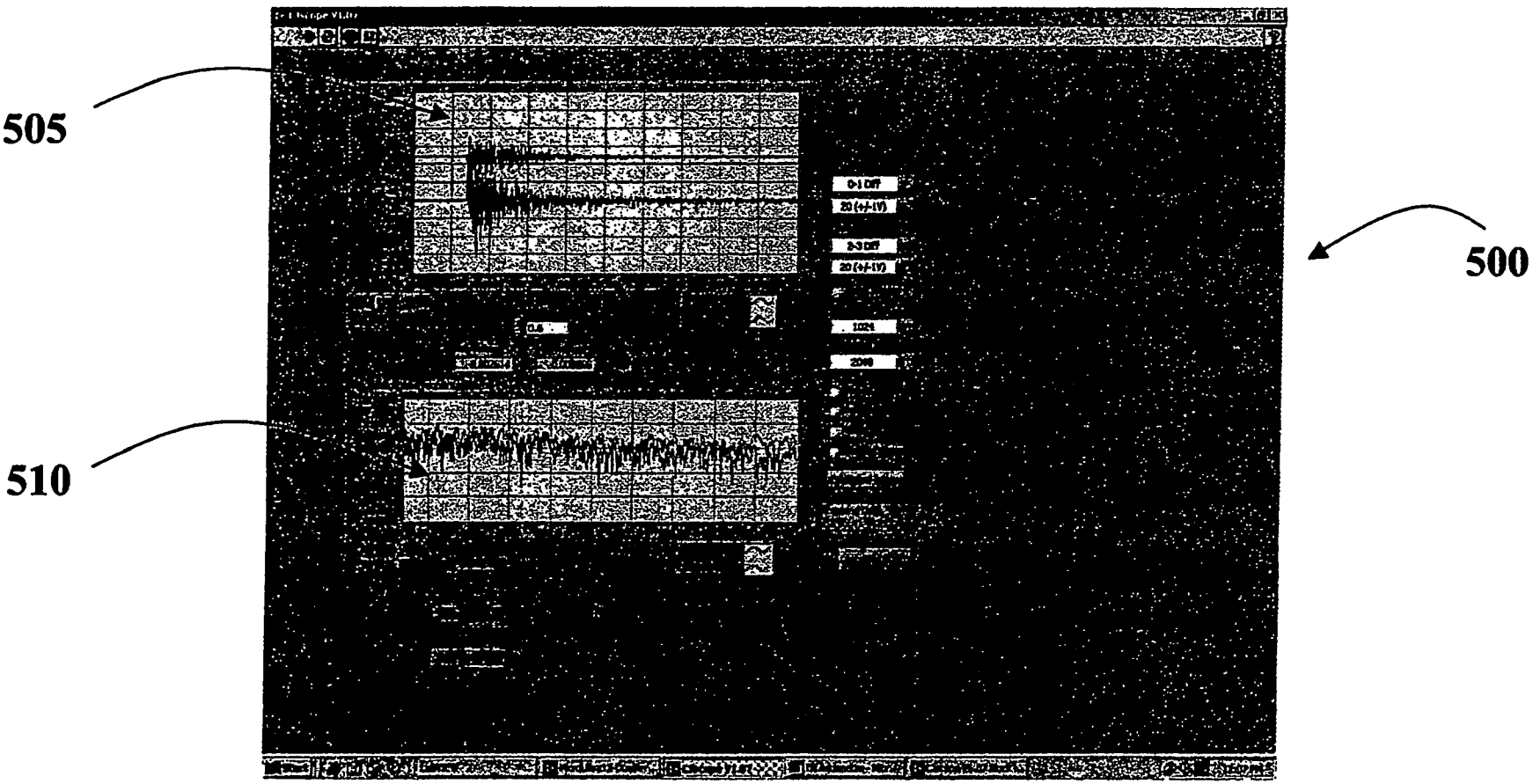
FIG. 7 is a computer display image with a graph showing a voltage response to impact along the sensor cable of the present invention.

In FIG. 7, the passive triboelectric function of the cable is illustrated from a test plot 500 comparison of the sensor cable 10, and the prior art Intelli-FLEX™ cable (not shown) when installed in a typical security application. The test plot 500 captures a time recording of the terminal voltage output of samples of the two cables which are tie wrapped linearly along a hundred feet of an eight foot chain-link fence when struck by a screwdriver. This disturbance simulates the type of signal received as the effect of an intruder trying to cut the fence.

The upper box 505 in FIG. 7 shows the time response, namely voltage versus time in seconds, the lower box 510 the response over frequency in Hertz. The upper trace in the top box 505 is the Intelli-FLEX™ sensor cable and the lower is the sensor cable 10 of the present invention. A small offset between the traces was introduced only to improve visibility. It should be noted that both measurements have a similar time and frequency response to the impact, however the sensor cable 10 of the present invention has a larger voltage response or "sensitivity".

The active detection with the sensor cable 10 has also been evaluated through experimentation with various processing means including applying the signal with a TDR, or alternatively from a pulse generator and then receiving the reflection from a directional coupler. The results show that the TDR measured return loss change from the above vibration is of the order of 35 dB compared to 46 dB for the comparable Intelli-FLEX™ cable. Thus, the response is much better over the prior art using the inexpensive sensor cable with a larger impedance change from the conductor looseness. Further experiments varying the centre conductor size in the RG-62 cable has shown a very minimal change in the passive sensitivity for conductor size between 16 and 26 AWG. Hence, the conductor can be optimized for other needs such as for impedance changes in the active role, or cable flexibility.

It should be further mentioned that basic processing means for passive systems using cables that produce a terminal voltage are relatively well known. These include filtering, amplifying and signal processing the signal to identify an intruder and yet be insensitive, i.e., not cause nuisance alarms, to environmental response such as wind and rain.

This, with current practice, can largely be done digitally, with the received signal directly digitized and processed in a microprocessor, digital signal processor (DSP), or similar device. Typically such passive sensing systems have no means to locate the intruder along the cable; however there are benefits to providing location of the intrusion along the sensor cable by active means. Active processing means may be implemented by many known means, as disclosed in a U.S. co-pending patent application, filed on Jul. 28, 2003, entitled "AN INTEGRATED SENSOR CABLE FOR RANGING" and assigned U.S. Ser. No. 10/627,618.

It should be understood that the preferred embodiments mentioned here are merely illustrative of the present invention. Numerous variations in design and use of the present invention may be contemplated in view of the following claims without straying from the intended scope and field of the invention herein disclosed.

Having thus described the invention, what is claimed as new and secured by Letters Patent is:

1. A flexible sensor cable for use in an intrusion detection system having a processor, the flexible sensor cable having an input and an output for coupling to the processor, the flexible sensor cable comprising:

a first electrically conductive cable member;

a second electrically conductive cable member;

an air separator and a plastic electrically insulating member both being disposed between the first conductive cable member and the second conductive cable member;

the first electrically conductive cable member having one surface in contact with the air separator and being freely movable within the air separator relative to the plastic electrically insulating member, such that the flexible sensor is capable of providing impedance change in response to a disturbance; and the plastic electrically insulating member being made of a material selected based on triboelectric series properties and being processed such that the flexible sensor cable is capable of producing a terminal voltage with acceptable signal to noise in response to a disturbance.

2. The flexible sensor cable as in claim 1, wherein the terminal voltage is produced based on an effect chosen from the group consisting of: triboelectric effect, electret effect, and triboelectric and electret effects.

3. The flexible sensor cable as in claim 1, wherein the sensor cable is a coaxial cable, and wherein the first electrically conductive cable member encloses the second electrically conductive cable member.

4. The flexible sensor cable as in claim 1, wherein the flexible sensor cable is a coaxial cable, and wherein the second electrically conductive cable member encloses the first electrically conductive cable member.

5. The flexible sensor cable as in claim 1, wherein the flexible sensor cable is a coaxial cable, wherein the second electrically conductive cable member encloses the first electrically conductive cable member, and wherein the sensor cable further includes an outer jacket and a second air separator, such that the second air separator is disposed between the outer jacket of the sensor cable and the plastic electrically insulating member, and wherein the second electrically conductive member has one surface in contact with the second air separator and being freely movable within the second air separator relative to the plastic electrically insulating member.

6. The flexible sensor cable as in claim 1, wherein the cable is a coaxial cable, and wherein the surface of the first electrically conductive cable member is coated with a dielectric layer.

7. The flexible sensor cable as in claim 1, wherein the cable is a twisted pair cable, wherein the plastic electrically insulating member is a plastic coating on the first electrically conductive cable member, and wherein the plastic coating is twisted with the second electrically conductive cable member.

8. The flexible sensor cable as in claim 1, wherein the plastic electrically insulating member is selected from the group consisting of: polyvinyl chloride, polyethylene, foamed polyethylene, and polypropylene.

9. The flexible sensor cable as in claim 1, wherein the cable is a threadless radio grade (RG) coaxial type cable.

10. The flexible sensor cable as in claim 1, wherein the cable is capable of producing the terminal voltage with an acceptable signal to noise ratio in response to the disturbance, the acceptable signal to noise being at least an order of magnitude larger than the noise averaged over a period of time.

11. An integrated flexible sensor cable for use in an intrusion detection system having a processor, the flexible sensor cable having an input and an output, both the input and the output of the sensor cable for coupling to the processor, the integrated sensor cable comprising:

a first electrically conductive cable member;

a second electrically conductive cable member;

an air separator and an plastic electrically insulating member both being disposed between the first conductive cable member and the second conductive cable member;

the first electrically conductive cable member having one surface in contact with the air separator and being freely movable within the air separator relative to the plastic electrically insulating member, such that the flexible sensor cable is capable of providing an impedance change in response to a disturbance; and the plastic electrically insulating member being made of a material selected based on triboelectric series properties and being processed such that the cable is capable of producing a terminal voltage with an acceptable signal to noise in response to the disturbance, the acceptable signal to noise ratio being at least an order of magnitude larger than the noise averaged over a period of time.

12. The integrated flexible sensor cable as in claim 11, wherein the cable is a coaxial cable, and wherein the first electrically conductive cable member encloses the second electrically conductive cable member.

13. The integrated flexible sensor cable as in claim 11, wherein the cable is, a coaxial cable, and wherein the second electrically conductive cable member encloses the first electrically conductive cable member.

14. The integrated flexible sensor cable as in claim 11, wherein the cable is a coaxial cable, and wherein the surface of the first electrically conductive cable member is coated with a dielectric layer.

15. The integrated flexible sensor cable as in claim 11, wherein the cable is a twisted pair cable, and wherein the plastic electrically insulating member is twisted together with the second electrically conductive cable member.

16. The integrated flexible sensor cable as in claim 11, wherein the cable is a threadless radio grade (RG) type cable.

17. A method of manufacturing an integrated flexible sensor cable for use with an intrusion detection system, comprising steps of:

a) selecting materials for construction of a coaxial cable, the coaxial cable having a first electrically conductive cable member, a second electrically conductive cable member, and an air separator, a threaded member, and an plastic electrically insulating member, the air separator, the threaded member, and the plastic electrically insulating member being disposed between the first electrically conductive cable member and the second electrically conductive cable member, and the threaded member being wound around the first electrically conductive cable member to prevent movement of the first electrically conductive cable member within the air separator, relative to the insulating member; and b) altering the construction to omit the threaded member from the manufacturing method to form a threadless coaxial cable, the first electrically conductive cable member having one surface in contact with the air separator and being freely movable within the air separator relative to the plastic electrically insulating member, and the plastic electrically insulating member being made of a material having suitable triboelectric series properties and being processed such that the threadless coaxial cable is capable of producing a terminal voltage with acceptable signal to noise in response to a disturbance.

18. The method of manufacturing as in claim 17, wherein the standard coaxial cable selected in step a) is a threaded radio grade (RG) cable.

19. A method of manufacturing an integrated flexible sensor cable for use with an intrusion detection system, comprising steps of:

a) selecting materials for construction of a coaxial cable, the coaxial cable having a first electrically conductive cable member, a second electrically conductive cable member, and an air separator, a threaded member, and an plastic electrically insulating member, the air separator, the threaded member, and the plastic electrically insulating member being disposed between the first electrically conductive cable member and the second electrically conductive cable member, and the threaded member being wound around the first electrically conductive cable member to prevent movement of the first electrically conductive cable member within the air separator, relative to the insulating member; and b) altering the construction to omit the threaded member from the manufacturing method to form a threadless coaxial cable, the first electrically conductive cable member having one surface in contact with the air separator and being freely movable within the air separator relative to the plastic electrically insulating member, such that the flexible sensor cable is capable of providing an impedance change in response to a disturbance, and the plastic electrically insulating member being made of a material having suitable triboelectric series properties and being processed such that the de-threaded coaxial cable is capable of producing a terminal voltage with an acceptable signal to noise in response to the disturbance, the acceptable signal to noise ratio being at least an order of magnitude larger than the noise averaged over a period of time.

20. The method of manufacturing as in claim 19, wherein the coaxial cable selected in step a) is a threaded radio grade (RG) cable, and further including the step of coupling the threadless coaxial cable to the intrusion detection system for use as a sensing element in the intrusion detection system.

21. An intrusion detection system comprising:

a flexible cable having a first electrically conductive cable member, a second electrically conductive cable member, and an air separator and an plastic electrically insulating member both being disposed between the first electrically conductive cable member and the second electrically conductive cable member, the first electrically conductive cable member having one surface in contact with the air separator and being freely movable within the air separator relative to the plastic electrically insulating member, such that the flexible cable is capable of providing an impedance change in response to a disturbance, and the plastic electrically insulating member being made of a material selected based on triboelectric series properties and being processed such that the flexible cable is capable of producing a terminal voltage with acceptable signal to noise in response to the disturbance; and a processor, operatively coupled to the flexible cable, for propagating, in an active state, an injected signal into the flexible cable and receiving a reflected signal altered by the impedance change along the flexible cable, and locating the disturbance based on a timing differential, and for generating a signal, in a passive state, in response to the terminal voltage produced from the flexible cable in order to detect the disturbance.

22. The intrusion detection system as in claim 21, further including switching means operatively coupled to the processor for alternating in a time sequence between the passive state and the active state.

23. The intrusion detection system of claim 21, further including switching means operatively coupled between the processor and the flexible cable to form a connection path to the flexible cable, and a time domain reflectometer, operatively coupled to the processor and the switching means, for propagating an injected signal into the cable and receiving a reflected signal altered by the impedance change along the flexible cable, wherein the switching means is capable of opening and closing the connection path to the flexible cable

* * * * *